US006223443B1

(12) United States Patent
Jacobs

(10) Patent No.: US 6,223,443 B1
(45) Date of Patent: May 1, 2001

(54) PATTERN DEVELOPING TOOL

(76) Inventor: Danny L Jacobs, 116 Summerford-Orr Rd., Falkville, AL (US) 35622

( * ) Notice: Subject to any disclaimer, the term of this patent is extended or adjusted under 35 U.S.C. 154(b) by 0 days.

(21) Appl. No.: 09/448,779

(22) Filed: Nov. 24, 1999

Related U.S. Application Data

(63) Continuation of application No. 08/944,722, filed on Oct. 6, 1997, now abandoned

(60) Provisional application No. 60/038,550, filed on Feb. 28, 1997.

(51) Int. Cl.[7] ..... B43L 9/04

(52) U.S. Cl. ..... 33/27.03; 33/760

(58) Field of Search ..... 33/27.03, 668, 33/759, 760, 761, 768, 770, DIG. 1

(56) References Cited

U.S. PATENT DOCUMENTS

| | | | | |
|---|---|---|---|---|
| 2,711,030 | * | 6/1955 | Drew et al. | 33/770 |
| 2,976,614 | * | 3/1961 | Matuszewski et al. | 33/27.03 |
| 3,120,059 | * | 2/1964 | Quenot | 33/27.03 |
| 4,103,426 | * | 8/1978 | Robin | 33/27.03 |
| 4,353,167 | * | 10/1982 | Martin | 33/27.03 |
| 4,760,648 | * | 8/1988 | Doak et al. | 33/668 |
| 5,014,436 | * | 5/1991 | Kozyrski et al. | 33/27.03 |
| 5,172,486 | * | 12/1992 | Waldherr | 33/768 |
| 5,253,421 | * | 10/1993 | Landmark | 33/768 |
| 5,477,619 | * | 12/1995 | Kearns | 33/27.03 |
| 5,711,085 | * | 1/1998 | Adams | 33/768 |
| 5,735,052 | * | 4/1998 | Lin | 33/760 |

* cited by examiner

*Primary Examiner*—G. Bradley Bennett

(57) ABSTRACT

A pattern developing tool comprising an axial pilot, pivotal bracket, and marker holder used with a retractable tape measure having a tab affixed to the zero end thereof a measured scale retractively coiled within a housing disposing a belt clip and means for locking the scale at predetermined measurements, wherein the marker holder cooperates with the tape measure belt clip, housing, and scale providing improved means for fastening a marking instrument to the tape measure housing. Said axial pilot is affixable to ferrous or non ferrous surfaces and operates to recieve the pivotal bracket adapted to fit the tape measure tab and scale, thus providing improved means for rotating the tape measure housing and marking instrument about an axis defined on the surface underlying the tape measure, permitting the user to draw accurate circles, arcs, and intersecting arcs for developing patterns on ferrous or non ferrous surfaces.

25 Claims, 4 Drawing Sheets

PATTERN DEVELOPING TOOL

CROSS-REFERENCE TO RELATED APPLICATIONS

This application is a continuation of Ser. No. 08/944,722 filed Oct. 6, 1997 abandoned and claims benefit of provisional application Ser. No. 60/038,550 filed Feb. 28, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to attachments used with a retractable tape measure to draw circles, arcs, and intersecting arcs and is an improvement over the device disclosed in my prior application, Ser. No. 08/944,722, now abandoned and incorporated by reference.

Acknowledging the technical field, sheet metal technicians, pipe fitters, and steel fabricators often rely on arc forming devices to draw circles, arcs, and intersecting arcs for developing full scale patterns common to their trades.

Since retractable tape measures are widely used in these operations, it is often convenient efficiency to fasten a marking instrument to a tape measure housing containing a retractable scale having a tab affixed to the zero end thereof the scale, wherein the tab is fastened to a pivotal means permitting the user to rotate the tape measure housing and marking instrument about an axis defined on the surface underlying the tape measure. With the marking instrument engaging the surface, the user can draw circles, arcs, and intersecting arcs for developing patterns thereon the surface underlying the tape measure.

Although prior inventions include a number of fixtures and attachments to be used with retractable tape measures to draw circles and arcs, it is believed the devices are not widely available because of manufacturing difficulties and the manner in which the devices operate.

Accordingly, it is an object of the present invention to provide a more efficient tool for drawing circles, arcs, and intersecting arcs for developing patterns on ferrous or non surfaces, wherein the pattern developing tool comprises an axial pivotal bracket, and marker holder used with a retractable tape measure having a tab affixed to the zero end thereof a measured scale retractively coiled within a housing disposing a belt clip and means for locking the scale at predetermined measurements, said pattern developing tool providing improved means for fastening a marking instrument to said housing and improved means for pivoting said housing and marking instrument about an axis defined on a ferrous or non ferrous surface underlying said tape measure, permitting the user to draw accurate circles, arcs, and intersecting arcs for developing patterns thereon said surfaces.

It is another object of the present invention to provide a pattern developing tool wherein said fastener means consists of a marker holder adapted to recieve and hold a flat soapstone or other preferred marking instrument, said marker holder disposing first and second channels, wherein said first channel cooperates with said tape measure belt clip to facilitate effective connection of said marker holder thereto said housing, said second channel cooperates with said tape measure scale and housing facilitating coplanar alignment of said marker holder therewith said scale and perpendicular alignment of said marking instrument therewith said underlying surface.

It is another object of the present invention to provide a pattern developing tool wherein said pivotal means consists of a pivotal bracket disposing a first aperture therein cooperating with opposed side walls to facilitate simultaneous connection and coplanar alignment of said pivotal bracket thereat said tab and scale, said pivotal bracket disposing a second aperture therein for recieving said axial pilot, wherein said axial pilot is affixable to ferrous or non ferrous surfaces underlying said tape measure, permitting the user to rotate said tape measure housing about an axis defined on said surfaces, whereby a marking instrument can be fastened to said marker holder connectable to said housing, permitting the user to draw accurate circles, arcs, and intersecting arcs for developing patterns thereon said surfaces.

DETAIL DESCRIPTION OF THE INVENTION

Figure 1:
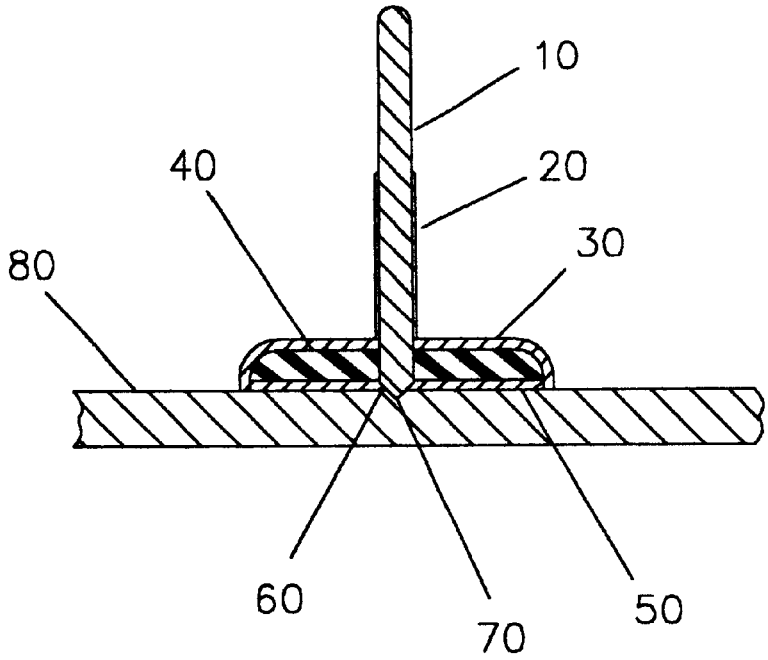
FIG. 1 is a cross section showing the axial pilot affixed to a ferrous or non ferrous metal plate.

Referring to FIG. 1, the axial pilot comprises a ferrous metal pin 10 engaging a cylindrical tube 20. Tube 20 is appended to a base 30 disposing a ferromagnet 40 wherein ferro suction pulls pin 10 downward causing point 60 to engage a center punched indentation 70 commonly used to mark a reference point or axis (see FIG. 3 80A) on a ferrous or non ferrous surface 80.

Used on ferrous surfaces, the axial pilot is effectively located and secured to the ferrous surface by means inherent ferromagnet 40 and pin 10.

Used on non ferrous surfaces, ferromagnet 40 disposes a removable adhesive disc 59 for cooperating with the non ferrous surface wherein the axial pilot is located by means inherent ferromagnet 40 and pin 10. The axial pilot is secured to the non ferrous surface by means inherent adhesive disc 50.

Figure 3:
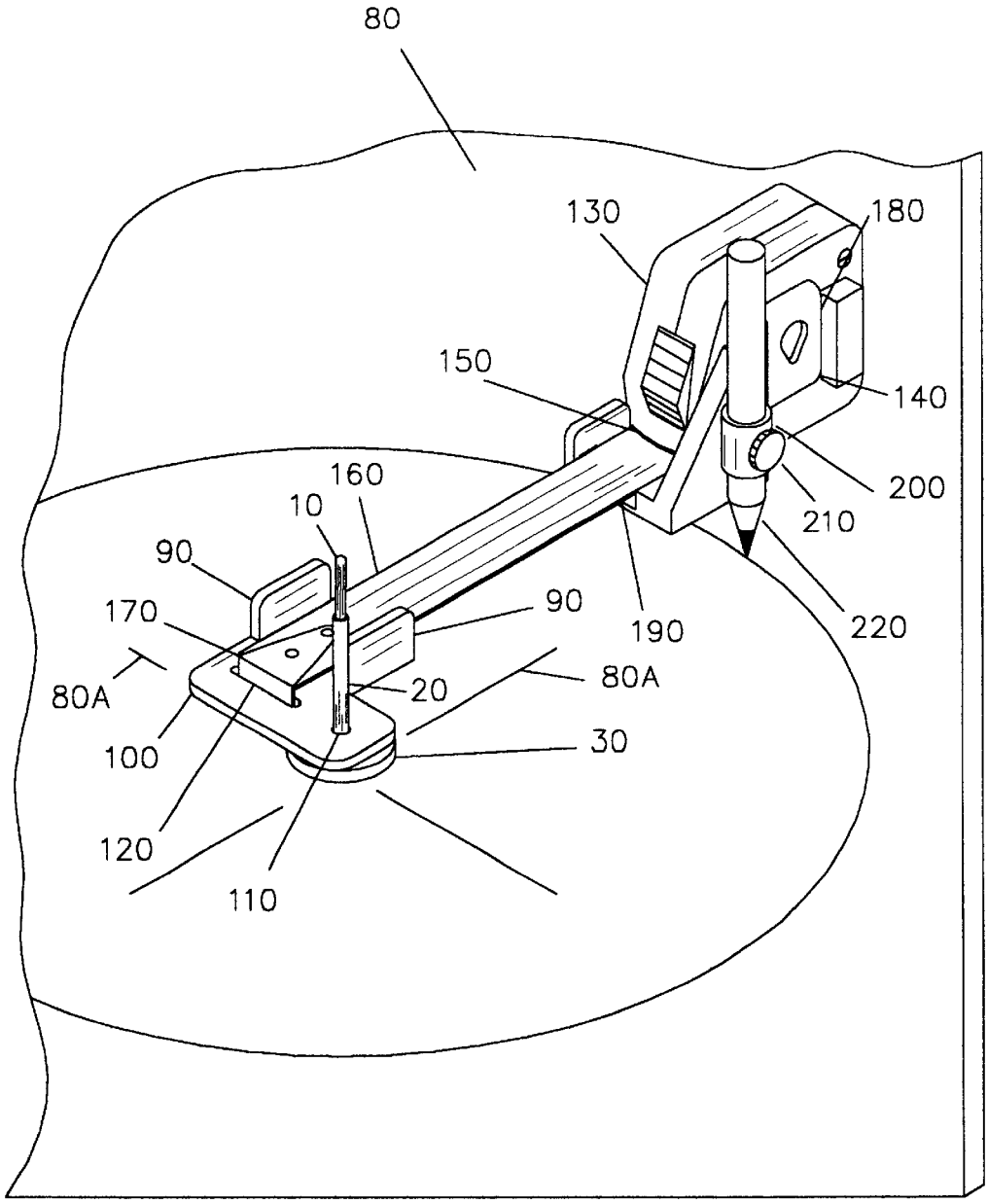
FIG. 3 is a perspective view showing the axial pilot, pivotal bracket, and marker holder in operant combination with a retractable tape measure and marking instrument.

FIG. 3 is a perspective view showing the axial pilot affixed at an axis 80A inscribed on a ferrous or non ferrous surface 80. for drawing patterns on template paper or poster board, the poster board or template paper is usually taped to a ferrous surface underlying the poster board or template paper wherein the axial pilot functions as used on a ferrous surface.

Thus, the axial pilot can be used on most any flat surface permitting the user to draw patterns directly onto template paper, poster board, ferrous or non ferrous metal plates, wood, plastics, etc.

Figure 2:
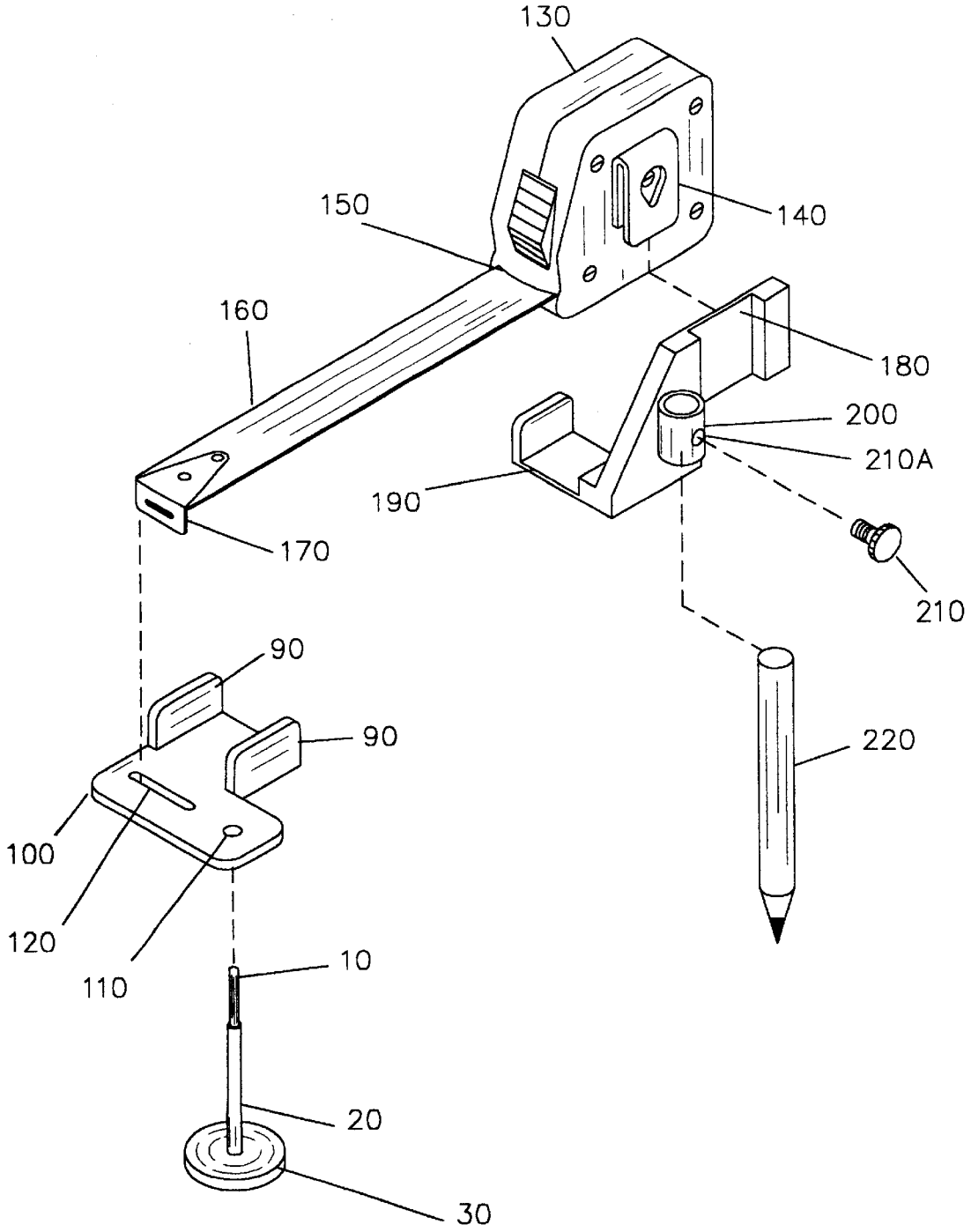
FIG. 2 is an exploded view showing the axial pilot, pivotal bracket, and marker holder separated from a marking instrument and a retractable tape measure.

Referring to FIGS. 2 and 3, the pivotal bracket consists of opposed side walls 90 appended to a base 100 disposing an open hole 110 for recieving cylindrical tube 20 of the axial pilot. Base 100 also disposes a slit 120 adapted to fit end tab 170. Accordingly, slit 120 defines predetermined interior width and length to facilitate frictional connection of the pivotal bracket at end tab 170. Opposed side walls 90 define predetermined interior width, height, and length to facilitate simultaneous frictional connection and coplanar alignment of the pivotal bracket at scale 160. These features are particularly important since the pivotal bracket must remain on the same plane as the marker holder and scale 160.

Figure 4:
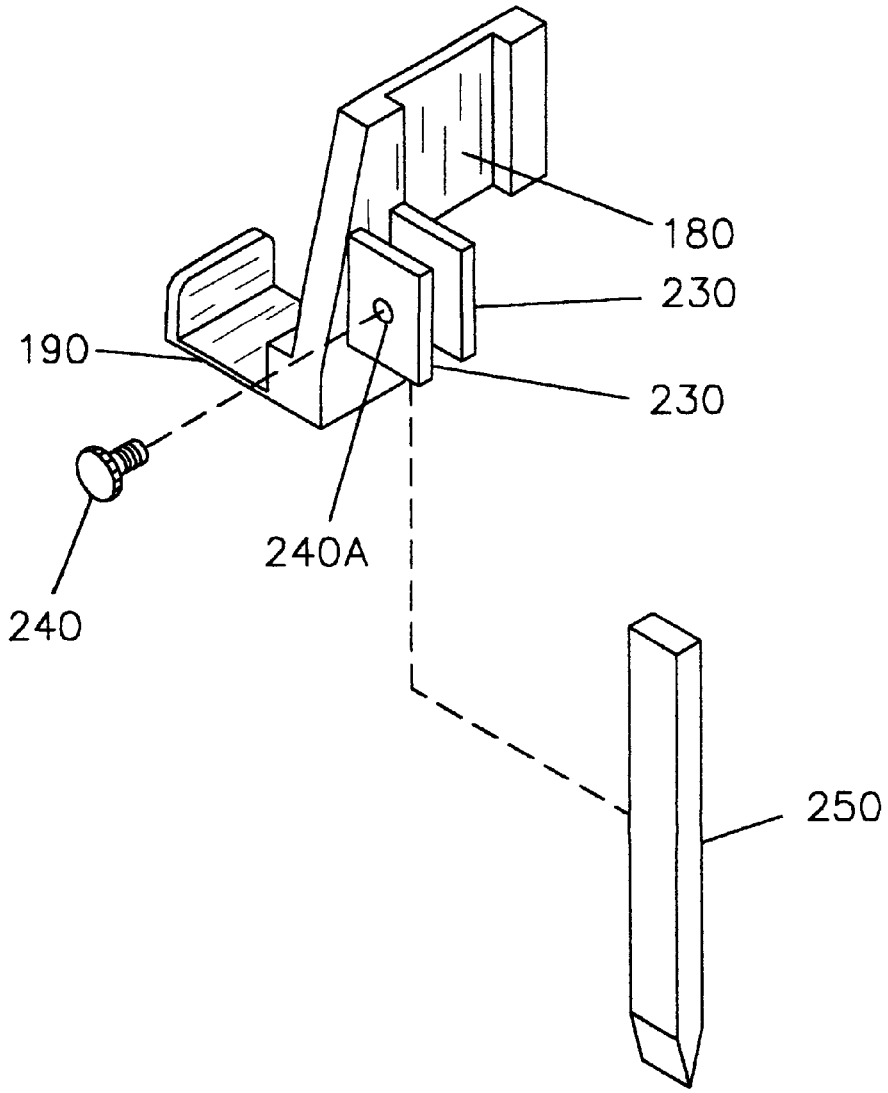
FIG. 4 is a perspective view showing an alternative marker holder adapted to recieve a flat soapstone.

Referring to FIGS. 2, 3, and 4, a marker holder having front and rear sides wherein the front side disposes a recessed channel 180 defining predetermined interior width, depth, and length to facilitate frictional connection of the marker holder at belt clip 140. The rear side of the marker holder disposes a second channel 190 to facilitate coplanar alignment of the marker holder at scale 160 wherein channel 190 defines predetermined interior width, depth, and length permitting effective extension and retraction of scale 160 at chase 150. These features are particularly important since the marker holder must remain on the same plane as the pivotal bracket and scale 160. Additionally, the front side of the marker holder disposes a cylindrical tube 200 having a threaded aperture 210A for cooperating with a mechanical fastner 210 to facilitate attachment of a preferred marking instrument 220 which may include dye markers, pencils, pins, etc. Additionally, one end of channel 190 engages tape housing 130 to facilitate perpendicular alignment of the marker holder at scale 160.

Referring to FIG. 4, an alternative marker holder disposes opposed side walls 230 one of which having a threaded aperture 240A for cooperating with a mechanical fastener 240 to facilitate connection of a flat soapstone 250 at the marker holder.

In conclusion of the detailed description on the invention, it should be noted that while there has been shown and described a preferred embodiment of the invention, it is understood that changes in structure, size, and materials can be made by those skilled in the art without departing from the improvements and advantages defined in the following claims.

I claim:

1. A tool for developing patterns wherein the tool comprises first, second, and third elements used in combination with a retractable tape measure, said tape measure comprising a perpendicular tab disposed at the zero end of a measured scale wherein the scale is retractively coiled within a housing, said housing having a belt clip and means for locking said scale at preferred measurements; wherein said first element comprises:

a releasable pilot comprising a cylindrical tube perpendicularly disposed at the center of a magnetic base, said tube disposing a ferro metal pin wherein the pin has a point shaped at one end for cooperating with a center punched indentation, said indentation defining an axis point defined on a ferro metal surface, wherein said pin cooperates with said tube and base, permitting the user to position and secure said pilot precisely at said axis point, wherein said pilot cooperates with said second element comprising:

a releasable clip defining a pivotal bracket wherein the pivotal bracket comprises opposed side walls perpendicularly disposed at a base, said base having first and second apertures wherein said first aperture defines a narrow slit for cooperating with said tab to fasten said pivotal bracket to said tab whereby said opposed side walls cooperate with said scale to facilitate fixed alignment of said pivotal bracket, tab, and scale, wherein said second aperture defines a through hole for connecting said pivotal bracket to said pilot, permitting the user to pivot said tape measure about said axis point , wherein said tape measure cooperates with said third element comprising:

a releasable clip defining a marker holder for fastening a marking instrument to said housing, said marker holder having front and rear sides disposing first and second channels and a receptacle, said receptacle disposing a mechanical fastener for fastening a marking instrument to said holder, wherein said first channel cooperates with said belt clip to fasten said marker holder to said housing whereby said second channel cooperates with said scale and housing to facilitate fixed alignment of said marker holder, scale, and housing, wherein a. said marker holder and pivotal bracket are fastened to said tape measure, b. a marking instrument is fastened to said marker holder, c. said pilot is secured at said axis point, d. said pivotal bracket is connected to said pilot whereby said marking instrument engages said surface, permitting the user to draw circles, arcs, or intersecting arcs for developing patterns on a ferro metal surface.

2. The tool of claim 1, wherein said releasable pilot comprises a cylindrical tube having a magnetic base wherein said base is perpendicular to said tube.

3. The tool of claim 2, wherein said tube defines predetermined inside and outside diameters wherein said inside diameter is symmetrical of a through hole located at the center of said magnetic base.

4. The tool of claim 3, wherein said tube defines a predetermined inside diameter for cooperating with a ferro metal pin, said pin having a point shaped at one end for cooperating with a center punched indentation wherein said indentation defines an axis point defined on a ferro metal surface.

5. The tool of claim 4, wherein said pin is telescopically projected through said tube and magnetic base, permitting the user to position said pilot precisely at said axis point.

6. The tool of claim 5, wherein ferro suction operates to hold said pilot precisely at said axis point.

7. The tool of claim 6, wherein ferro suction operates to hold said pin inside said tube and magnetic base while said pilot is released from said ferro metal surface.

8. The tool of claim 7, wherein ferro suction pulls said pin downward whereby said point engages said indentation to enhance securement of said pilot at said axis point.

9. The tool of claim 1, wherein said cylindrical tube defines a predetermined outside diameter for cooperating with said through hole in said pivotal bracket.

10. The tool of claim 1, 2, 3, 4, 5, 6, 7, 8, or 9, wherein said magnetic base has a releasable adhesive disc, said disc having a through hole symmetrical of said through hole in said base; wherein said adhesive disc cooperates with said magnetic base, cylindrical tube, and ferro metal pin, permitting the user to secure said pilot precisely at an axis point defined on either of a variety of surfaces, including a ferro or non ferro metal surface.

11. The tool of claim 1, wherein said pivotal bracket comprises opposed side walls perpendicularly disposed at a base, said base having first and second apertures wherein said first aperture defines a narrow slit, said slit defining predetermined interior width and length for frictionally fitting about said tab at said scale.

12. The tool of claim 11, wherein said opposed side walls are perpendicular to said base, said side walls defining predetermined interior width, length, and height for frictionally fitting about said scale at said tab.

13. The tool of claim 11, wherein said slit cooperates with tab to fasten said pivotal bracket to said tab whereby said opposed side walls cooperate with said scale to facilitate fixed alignment of said pivotal bracket, tab, and scale.

14. The tool of claim 11, wherein said second aperture defines a through hole defining a predetermined inside diameter for cooperating with said outside diameter defined at said tube comprised at said pilot, whereby connecting said tab, bracket, and pilot, permits the user to pivot said tape measure about said axis point.

15. The tool of claim 1, wherein said marker holder has front and rear sides disposing first and second channels and a cylindrical receptacle, wherein said receptacle has predetermined inside and outside diameters defining a diametrical wall disposing a threaded through hole for cooperating with a mechanical fastener to fasten a marking instrument to said marker holder.

16. The tool of claim 15, wherein said marking instrument defines either of a variety of marking instruments including a pen, a pencil or a dye marker.

17. The tool of claim 16, wherein said marking instrument is telescopically projected through said receptacle, permitting the user to position and fix said marking instrument at preferred elevations relative to said marker holder.

18. The tool of claim 15, wherein said first channel defines a recess having predetermined interior width, depth, and length for frictionally fitting about said belt clip.

19. The tool of claim 15, wherein said receptacle and said first channel are disposed at said front side.

20. The tool of claim 15, wherein said second channel is disposed at said rear side.

21. The tool of claim 20, wherein said second channel comprises a bottom having opposed side walls having front and rear ends, wherein said bottom is perpendicular to said rear side.

22. The tool of claim 21, wherein said opposed side walls define predetermined interior width, height, and length for frictionally fitting about said scale and engaging said housing to facilitate fixed alignment of said marker holder, scale, and housing.

23. The tool of claim 22, wherein said opposed side walls define predetermined interior width, height, and length to facilitate telescopical extension and retraction of said scale through said channel.

24. The tool of claim 1, 15, 16, 17, 18, 19, 20, 21, 22, or 23, wherein said marker holder has front and rear sides wherein said front side has a receptacle for fastening a flat soapstone to said marker holder, said receptacle comprising opposed side walls at least one of which has a threaded through hole for cooperating with a mechanical fastener to fasten said soapstone to said marker holder, wherein said side walls define predetermined interior width, depth, and height for telescopically projecting said soapstone through said receptacle, permitting the user to position and fix said soapstone at preferred elevations relative to said marker holder.

25. In combination, a tool for developing patterns wherein the tool is used with a retractable tape measure, said tape measure having a tab at the zero end of a measured scale wherein the scale is retractively coiled within a housing, said housing having a belt clip and means for locking said scale at preferred measurements; said tool comprising:

a first element defining a releasable pilot comprising a cylindrical tube having a magnetic base, said tube disposing a ferro metal pin having a point shaped at one end for cooperating with a center punched indentation, said indentation defining an axis point defined on a ferro metal surface, wherein said pin cooperates with said tube and magnetic base, permitting the user to secure said pilot precisely at said axis point defined on a ferro metal surface; wherein said magnetic base has a releasable adhesive disc for cooperating with said magnetic base, cylindrical tube, and ferro metal pin, permitting the user to secure said pilot precisely at said axis point defined on either of a variety of surfaces, including a ferro or non ferro metal surface, wherein said pilot cooperates with a second element consisting of a releasable clip defining a pivotal bracket, said bracket comprising opposed side walls disposed at a base, said base disposing first and second apertures wherein said first aperture defines a narrow slit for cooperating with said tab to fasten said pivotal bracket to said tab whereby said opposed side walls cooperate with said scale to facilitate fixed alignment of said pivotal bracket, tab, and scale, wherein said second aperture defines a through hole for connecting said pivotal bracket to said pilot, permitting the user to pivot said tape measure about said axis point, wherein said tape measure cooperates with a third element consisting of a releasable clip defining a marker holder for fastening a marking instrument to said housing, wherein said marker holder has front and rear sides disposing first and second channels and a receptacle, said receptacle having a mechanical fastener for fastening a pen, pencil, dye marker, or flat soapstone to said marker holder, wherein said first channel cooperates with said belt clip to fasten said marker holder to said housing whereby said second channel cooperates with said scale and housing to facilitate fixed alignment of said marker holder, scale, and housing, wherein a. said marker holder and pivotal bracket are fastened to said tape measure, b. a marking instrument is fastened to said marker holder, c. said pilot is secured at said axis point, d. said pivotal bracket is connected to said pilot whereby said marking instrument engages said surface, permitting the user to draw circles, arcs, or intersecting arcs for developing patterns on either of said surfaces.

* * * * *